US005172027A

United States Patent [19]

Nonomura et al.

[11] Patent Number: 5,172,027

[45] Date of Patent: Dec. 15, 1992

[54] WIRE SHAPED ELECTRON SOURCE

[75] Inventors: Kinzo Nonomura, Ikoma; Jumpei Hashiguchi, Neyagawa; Ryuichi Murai, Katano; Kiyoshi Hamada, Sakai; Satoshi Kitao, Kyoto, all of Japan

[73] Assignee: Matsushita Electric Industrial Co., Ltd., Osaka, Japan

[21] Appl. No.: 743,224

[22] Filed: Aug. 9, 1991

[30] Foreign Application Priority Data

Aug. 10, 1990 [JP] Japan ..... 2-212856

[51] Int. Cl.[5] ..... H01J 19/08

[52] U.S. Cl. ..... 313/341; 313/343; 313/344; 313/345; 313/346 R; 313/269

[58] Field of Search ..... 313/269, 341, 343, 344, 313/345, 422, 346 R

[56] References Cited

U.S. PATENT DOCUMENTS 4,551,737 11/1985 Inokuchi ..... 313/422

FOREIGN PATENT DOCUMENTS 54-24570 2/1979 Japan .
60-84744 5/1985 Japan .
66348 4/1986 Japan ..... 313/422
230239 10/1986 Japan ..... 313/422
61-243633 10/1986 Japan .
62-188130 8/1987 Japan .
2-270252 11/1990 Japan .

*Primary Examiner*—Donald J. Yusko
*Assistant Examiner*—N. D. Patel
*Attorney, Agent, or Firm*—Wenderoth, Lind & Ponack

[57] ABSTRACT

A wire shaped electron source includes a heating core wire, an insulator partially provided on the heating core wire, and an electron emission material provided on the heating core between the insulators. The thickness of the electron emission material is less than the height of the insulators. When the wire shape electron source is installed in a flat panel display device, the insulator prevents the electron emission material from vibrating thus preventing any contact with the inner wall of the flat panel display device.

18 Claims, 4 Drawing Sheets

WIRE SHAPED ELECTRON SOURCE

BACKGROUND OF THE INVENTION

1. Field of the Invention

The present invention relates to a wire shaped electron source for radiating electrons and, more particularly, to a wire shaped electron source which functions as a filament cathode for use in a flat panel display device.

2. Description of the Prior Art

In general, wire shaped electron sources are commonly used as filament cathodes in fluorescent display devices, thin tube CRT display devices, and similar products. As shown in FIG. 4, a wire shaped thermionic cathode 42 comprising an electron emission oxide material 41 applied around a tungsten core 40 with a diameter of approximately 20 μm is widely used in the above display devices. The wire shaped thermionic cathode 42 is riding on supports 43 in a tensioned state. The tungsten core 40 is used to heat the wire-shaped thermionic cathode 42 to emit electrons from the electron emission material 41.

In a display device having a large display area, it is possible to use a long wire-shaped thermionic cathode 42 in a tensioned state, but the brightness of the emitted light from the phosphors varies when the wire-shaped thermionic cathode 42 vibrates, as in the manner described in the Japanese Laid-open Patent Publication No. 5424570, published Feb. 13, 1979.

To prevent such vibration, a center support Sc is provided at the center portion of the long wire shaped thermionic cathode 42. However, the center support Sc contacts the wire shaped thermionic cathode 42 and scrapes off the electron emission material 41 laminated on the cathode 42. The scraped off particles of the electron emission oxide material become dust, which adheres to other components, such as an electron beam extraction electrode 44, degrading the ability of the emission of electrons from the cathode 42.

As shown in FIG. 5, to prevent the vibration of the cathode and the scraping off of the electron emission material, a spiral wire shaped thermionic cathode is proposed, such as described in the Japanese Laid-open Patent Publication No. 61243633, published Oct. 29, 1986. A spiral wire shaped thermionic cathode 53 is arranged between a back electrode means 51 and an electron beam extraction electrode 52. The wire shaped thermionic cathode 53 is formed by the application of an electron emission oxide material 56 over a heater wire comprising a tungsten core 54 and a tungsten coil core 55. The wire shaped thermionic cathode 53 is processed through a die to remove the electron emission material 56 from the outer surface of the coil core 55. The resulting cathodes 53 are then tensely stretched with slight contact with spacers 57 formed on the electron beam extraction electrode 52.

However, in the prior art wire shaped thermionic cathode 53 as thus described, because the spiral core 55 is made of the same tungsten metal wire as the straight core wire 54, the electron emission material 56 adheres not only to the straight core wire 54 but also to the outer surface of the spiral core 55 when it is applied with electrodeposition or a spray method used in heater wire production. As a result, to remove the electron emission material 56 adhering to the outer surface of the spiral core wire 55, the wire shaped thermionic cathode 53 is passed through a die.

It is, however, difficult to sufficiently remove the electron emission material 56 from the outer surface of the spiral core wire 55, resulting in various problems, such as insufficient removal of the electron emission material 56 from the spiral core wire 55 or too much removal of the electron emission material 56 from the straight core wire 54 to cause uneven emission of electrons from the wire-shaped thermionic cathodes 53.

The object of the present invention is therefore to provide a wire-shaped electron source which will not make any vibrations and which can maintain the electron emission oxide material on the electron source to produce no dust or the like.

In Japanese Laid-open Patent Publication No. 2270252, published Nov. 5, 1990, an electron source as shown in FIG. 6 is disclosed, which has a metallic or insulated filament 2 wound in a spiral pattern around a filament cathode 1 applied with an electron emission material so as to prevent the vibration of the cathode 1.

In FIG. 7, a modification of the electron source of FIG. 6 is shown. An electron emission material 34 is applied to a heater wire 35 defined by a straight core wire 31 wound with a coil 32 spirally to form a cathode 1', and a filament 33 is spirally wound on to the cathode 1' in an attempt to diminish the vibration of the cathode 1'.

Although the arrangement of FIG. 7 reduces the vibrations of the cathode 1', by the filament 33 spirally wrapping therearound, undesirable dust is produced as explained below. The spirally wound filament 33 is in partial contact with the electron emission material 34, which is less adhesive, and soft and spongy at a center portion thereof. Thus, the electron emission material can be easily scraped off by the filament 33. In addition, when the filament cathode vibrates, the filament 33 contacts a vibration prevention means. The contact pressure is transmitted directly to the electron emission material 34, frequently causing the electron emission material 34 to separate and peel off.

SUMMARY OF THE INVENTION

The present invention has been developed with a view to substantially solving the above described disadvantages, and has for its essential object to provide an improved wire shaped electron source.

In order to achieve the aforementioned objective, a wire shaped electron source for use in a flat panel display comprises heating core means for generating heat, insulating means provided on an outer surface of the heating core means to partially cover the outer surface, and electron emission means provided on the outer surface of the heating core means at places other than that provided with the insulating means.

BRIEF DESCRIPTION OF THE DRAWINGS

These and other objects and features of the present invention will become clear from the following description of the preferred embodiments thereof with reference to the accompanying drawings, throughout which like parts are designated by like reference numerals, and in which.

DETAILED DESCRIPTION OF THE PREFERRED EMBODIMENTS

Figure 1:
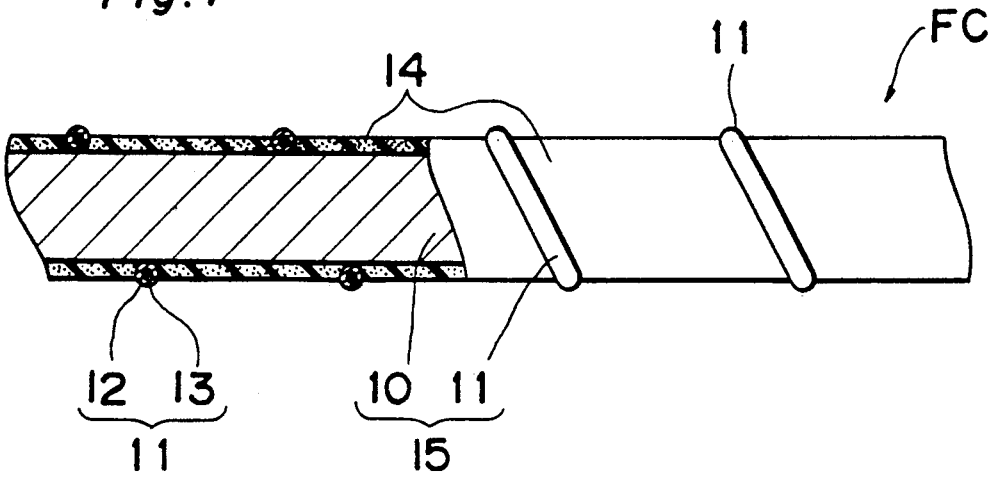
FIG. 1 a fragmentary cross sectional view of a wire shaped electron source according to a first embodiment of the present invention.

Referring to FIG. 1, a wire shaped electron source according to a first embodiment of the present invention is shown. A wire shaped electron source FC comprises a straight wire core 10, a spiral insulating wire 11 which is wound on the straight wire core 10 spirally, and an electron emission material 14 applied on the straight wire core 10 and in the spaces between the spiral insulating wire 11. Since the thickness of the emission material 14 applied on the wire core 10 is less than the diameter of the spiral insulating wire 11, the wire 11 is not completely covered by the emission material 14.

The straight wire core 10 is made of a tungsten wire approximately 10 to 30 μm in diameter. The insulating wire 11 is formed by a wire core 12 which is coated with an insulation coating 13. The wire core 12 is made of tungsten of approximately 5 to 10 μm diameter. The insulator 13 is made of alumina of approximately 5 μm thick on the surface of the wire core 12. The winding pitch of the spiral insulating wire 11 around the straight wire core 10 is approximately 100 μm. The electron emission material 14 includes barium or another oxide materials.

The spiral insulating wire 11 is manufactured by the steps of immersing the tungsten wire 12 in an electrodeposition solution containing alumina powder and applying an electric current through the tungsten wire 12 to adhere the alumina insulation coating 13. The wire 12 with the alumina insulation coating 13 is then heated at a high temperature, between approximately 1600° to 1800° C., to sinter the adhered alumina coating to produce a firmly adhered insulation coating 13. The insulating wire 11 is then wound spirally on the straight wire core 10 to form a heater wire 15 to which the electron emission material 14 is not yet applied. The heater wire 15 is then immersed in an electrodeposition solution containing barium carbonate or other material which is capable of emitting electrons. The electrodeposition process is executed to deposit the electron emission material 14 on the heater wire 15. The deposited thickness of the barium carbonate or other oxide electron emission material formed on the straight wire core 10 can be easily controlled by controlling the period of time the electrodeposition process is carried out.

Instead of spiral winding, the insulating wire 11 can be applied to the straight wire core 10 in any other pattern, such as in segments of insulating wire 11. Furthermore, other insulation material, such as quartz glass fiber without the tungsten core 12, can be used as the insulating wire 11 spirally wound around the core wire 10. Thus, a wire shaped electron source which is substantially equivalent to the present embodiment can be manufactured in even a simpler manufacturing process.

Figure 2:
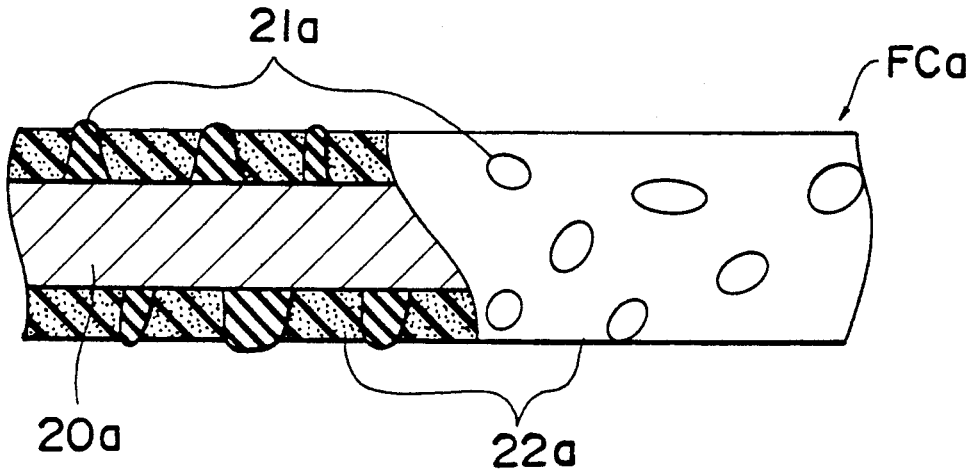
FIG. 2 is a fragmentary cross sectional view of a wire shaped electron source according to a second embodiment of the present invention.

Referring to FIG. 2, a wire shaped electron source FCa according to a second embodiment of the present invention is shown. A wire shaped electron source FCa comprises a straight wire core 20*a*, a plurality of insulating struts 21*a* located on the surface of the straight wire core 20*a* in a variety of shapes, and an electron emission material 22*a* applied on the surface of the straight wire core 20*a* in the space between the insulating struts 21*a* at a thickness less than the height of the insulating struts 21*a*.

The straight wire core 20*a* is made of a tungsten wire of approximately 20 μm diameter. The plurality of insulating struts 21*a* are made of alumina of approximately 5 to 10 μm height and are separated some tens to some hundreds of μm apart from each other. The electron emission material 22*a* is formed by barium carbonate or another oxide materials.

Figure 3:
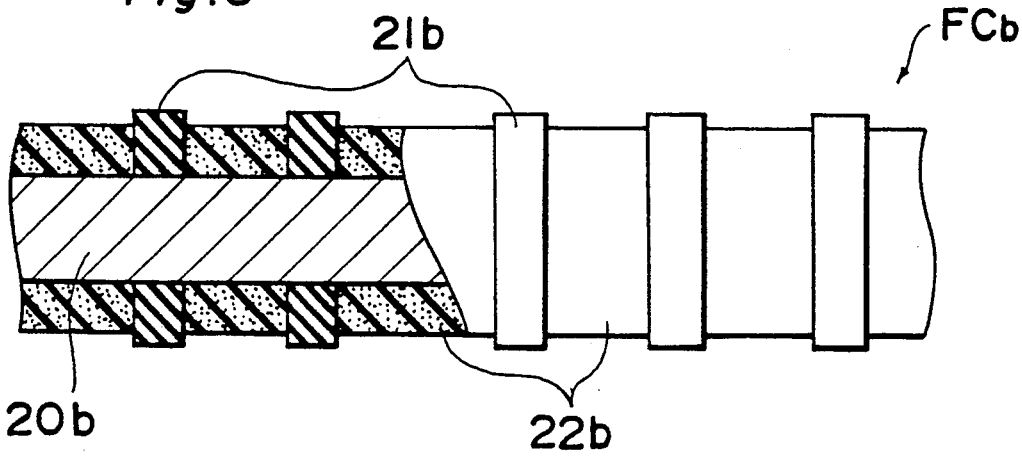
FIG. 3 is a fragmentary cross sectional view showing a modification of the wire shaped electron source of FIG. 2.
Figure 4:
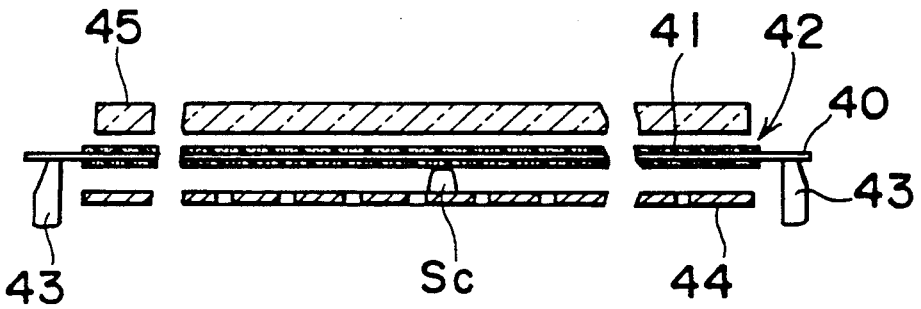
Fig. 4 PRIOR ART
FIG. 4 is a schematic view showing a prior art wire shaped electron source which is riding on supports at both ends in a flat panel display device.
Figure 5:
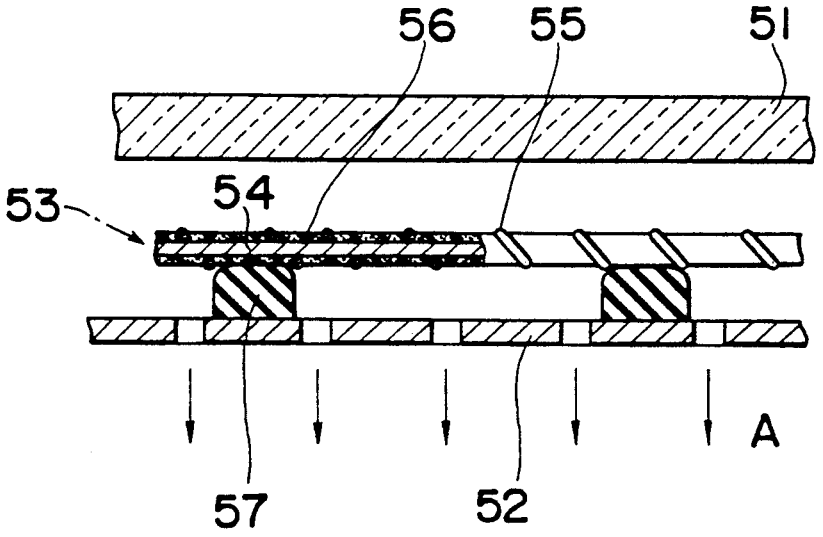
Fig. 5 PRIOR ART
FIG. 5 is a schematic view of another prior art wire shaped electron source riding on spacers of flat panel display device.
Figure 6:
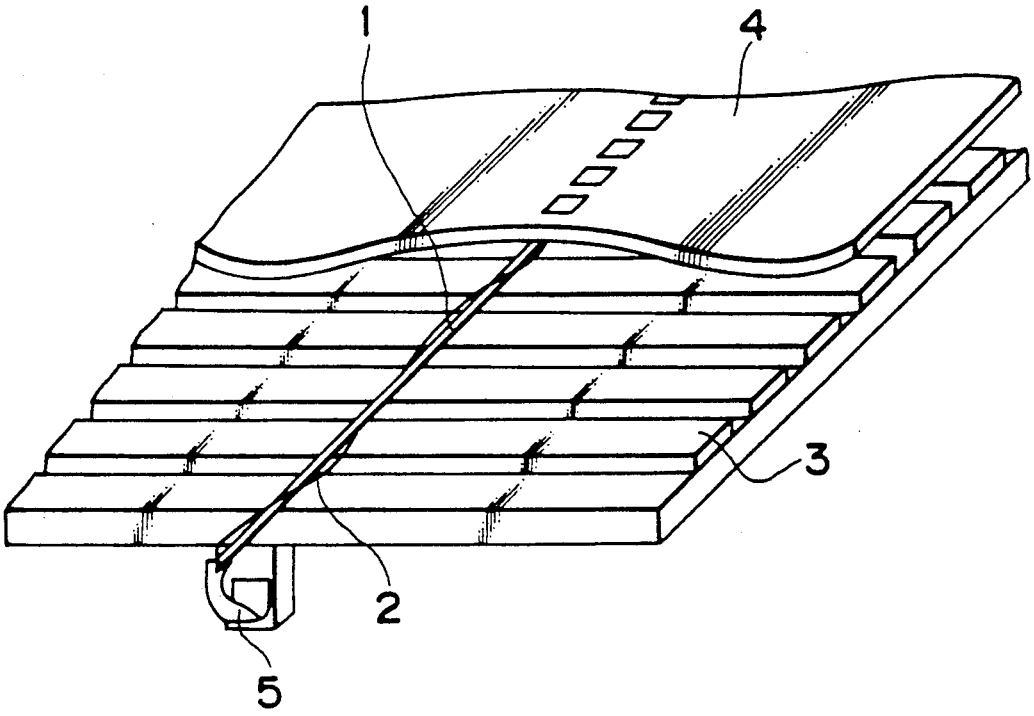
Fig.6 PRIOR ART
FIG. 6 is a schematic perspective view of yet another prior art wire shaped electron source with a spring wire wound around riding on supports at both ends in a flat panel display device.
Figure 7:
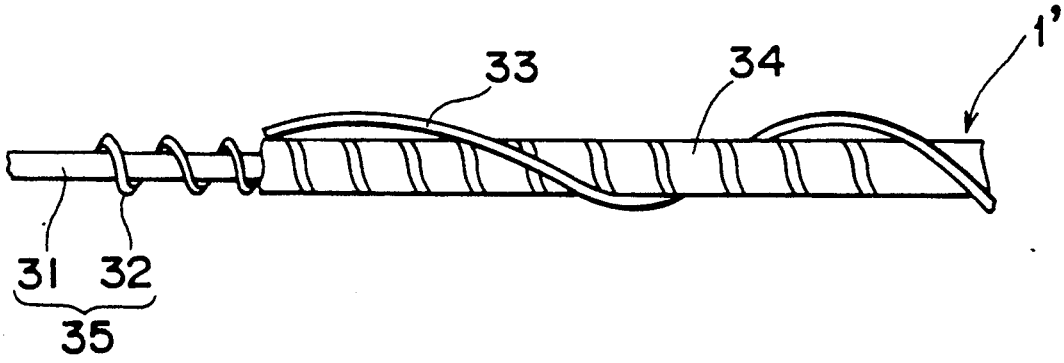
Fig. 7 PRIOR ART
FIG. 7 is a fragmentary view of still another prior art wire shaped electron source with a spring wire wound therearound.

Referring to FIG. 3, a wire shaped electron source FCb is shown, which is a modification of the second embodiment of the present invention. The wire shaped electron source FCb comprises a straight wire core 20*b*, a plurality of insulating rings 21*b*, each of which is approximately 5 to 10 μm wide and is firmly mounted on the straight wire core 20*b* at a pitch of several ten to several hundreds of μm, and an electron emission material 22*b* deposited between the insulating rings 21*b* at a thickness less than the height of the insulating rings 21*b*.

The above mentioned wire shaped electron source FCa (or FCb) according to the second embodiment of the present invention can be manufactured in the following manner.

At first, photoresist is applied to the tungsten wire 20*a* (or 20*b*). For the wire shaped electron source FCa, a mesh mask with random holes is wrapped around the tungsten wire 20*a*, which is then exposed to the light and then developed. The resultant is such that the photoresist applied on the core wire 20*a* is formed with a plurality of holes suitably dispersed. For the wire shaped electron source FCb, circular bands are applied around the tungsten wire 20*b*, which is then exposed to light to form a tungsten wire 20*b* with ring shaped cavities corresponding to the circular bands is obtained after development.

Next, by placing the developed tungsten wire 20*a* (or 20*b*) in an electrodeposition solution containing alumina powder and applying an electric current through the tungstenwire 20*a* (or 20*b*), alumina projections are formed on the tungsten wire 20*a* (or 20*b*) at places where the photoresist is removed. The alumina projections deposited on tungsten wire 20*a* (or 20*b*) grows into nipple-shaped projections or ring-shaped projections during the supply of electric current.

Then, by heating the alumina projections to a temperature between 1600° C. to 1800° C., the photoresist is baked away and the alumina insulators 21*a* (or 21*b*) are sintered and deposited firmly on the tungsten wires 20*a* (or 20*b*).

Next, the tungsten wires 20*a* (or 20*b*) with the sintered alumina insulators 21*a* (or 21*b*) are immersed in an electrodeposition solution containing the barium carbonate or other material which is suitable for forming the electron emission material 22*a* (or 22*b*). Then, an electric current is supplied through the wire 20*a* (or 20*b*) so as to deposit the electron emission layer 22*a* (or 22*b*) on the core wire 20*a* (or 20*b*) at places where the projections 21*a* (or 21*b*) are not provided. The thickness of the electron emission layer 22*a* (or 22*b*) can be easily controlled by the time length of the electric current supplied through the core wire 20*a* (or 20*b*). By the above steps, the wire shaped electron source FCa (or FCb) according to the second embodiment of the present invention is obtained.

As is apparent from the above descriptions, the wire shaped electron source according to the present invention produces no vibrations. Also, the electron emission material can be firmly provided on the core wire to produce no dust inside the cavity of the flat panel display because the surface of the electron emission material is below an imaginary face extending along the peak points of the insulating material, and also because the electron emission material is adhered firmly on the surface of the straight core wire by the electrodeposition process.

Furthermore, according to the present invention, since the electron emission material is formed by the step of electrodeposition, the thickness of the electron emission material can be made less than the height of the insulating material by controlling the time length of the electric current supply. Thus it is not necessary to process the wire shaped electron source through the dies.

Furthermore, according to the present invention, since the electron emission material is applied to the straight core wire by electrodeposition or another method after the insulating material is applied to the straight core wire, the electron emission material does not adhere to the previously applied insulating material but adheres only to the exposed part of the core wire where the electrodeposition can be effected.

Thus, according to the present invention, since the thickness of the electron emission material is less than the height of the applied insulating material, contact between the inner walls of the flat panel display and the wire shaped electron source occurs only at the insulating material. In other words, there is no contact between the inner walls of the flat panel display and the electron emission material. Therefore, separation or peeling of the electron emission material does not occur.

Figure 8:
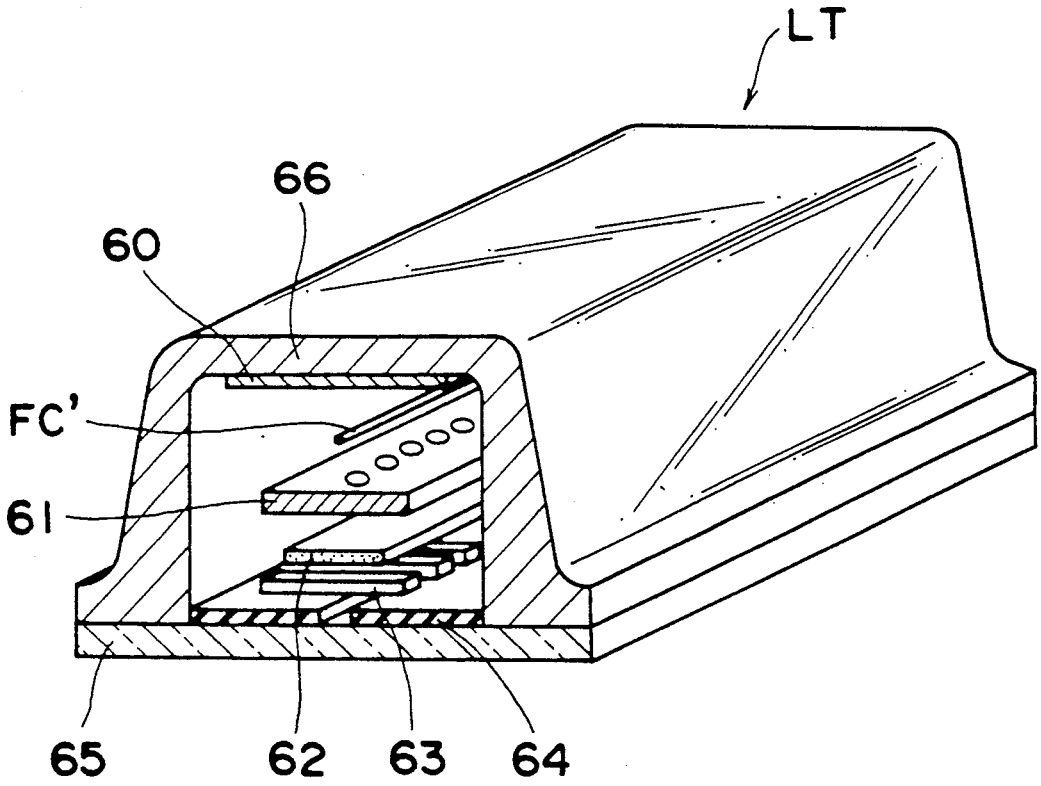
FIG. 8 is a cross sectional perspective view showing a wire shaped electron source according to the present invention installed in a tubular illuminating device.

Referring FIG. 8, a wire shaped electron source FC' installed in a tubular illuminating device LT is shown. The tubular illuminating device LT includes a back electrode 60, an electron extraction electrode 61, a fluorescent plate 62, a transparent anode 63, light shields 64, a transparent face plate 65, and a casing 66, which is constructed as shown in FIG. 8. The wire shaped electron source FC' is arranged between the back electrode and the electron extraction electrode 61. Since the tubular illuminating device LT thus constructed can impinge electrons on the fluorescent plate 61 at an optional pattern by controlling the signal voltage applied to the anode 63 and irradiates the light at the same pattern through the face plate 65, the device LT can produce optional patterns on the photosensitive unit of such devices as the copying machines and the facsimile machine.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A wire shaped electron source comprising:

a heating core for generating heat;

an insulator fixed on an outer surface of said heating core so as to define an integral unit together with said heating core, said insulator partially covering said outer surface of said heating core; and an electron emission material provided on said outer surface of said heating core at places on said outer surface other than those provided with said insulator;

wherein said insulator has a height, as measured from said outer surface of said heating core, which is greater than the thickness of said electron emission material on said heating core.

2. The wire shaped electron source as claimed in claim 1, wherein said heating core is straight and said insulator is a wire spirally wound around said heating core.

3. The wire shaped electron source as claimed in claim 2, wherein said wire comprises a metal core and an insulating coating surrounding said metal core.

4. The wire shaped electron source as claimed in claim 3, wherein said metal core comprises a tungsten wire of approximately 5 to 10 μm in diameter.

5. The wire shaped electron source as claimed in claim 3, wherein said insulating coating comprises alumina having a thickness of approximately 5 to 10 μm thickness.

6. The wire shaped electron source as claimed in claim 2, wherein said wire comprises insulation material.

7. The wire shaped electron source as claimed in claim 6, wherein said insulation material is a glass fiber.

8. The wire shaped electron source as claimed in claim 1, wherein said heating core comprises a tungsten wire approximately 10 to 40 μm in diameter.

9. The wire shaped electron source as claimed in claim 1, wherein said insulator comprises a plurality of insulating projections.

10. The wire shaped electron source as claimed in claim 9, wherein said heating core comprises a straight core wire and each said insulating projection comprises alumina deposited on said outer surface of said straight core wire.

11. The wire shaped electron source as claimed in claim 10, wherein said plurality of insulating projections are separated from each other on said straight core wire at a spacing of several tens to several hundreds of micrometers.

12. The wire shaped electron source as claimed in claim 11, wherein said plurality of insulating projections are approximately 5 to 10 μm in height.

13. The wire shaped electron source as claimed in claim 10, wherein each said insulating projection is a ring surrounding said straight core wire.

14. The wire shaped electron source as claimed in claim 13, wherein each said ring is approximately 5 to 10 μm wide.

15. The wire shaped electron source as claimed in claim 14, wherein said rings are on said straight core wire at a pitch of approximately several tens to several hundreds of mircrometers.

16. The wire shaped electron source as claimed in claim 1, wherein said insulator is an electrodeposit fixed to said outer surface of said heating core by electrodeposition.

17. The wire shaped electron source as claimed in claim 1, wherein said electron emission material is an electrodeposit formed on said heating core by electrodeposition after said insulator has been fixed to said heating core.

18. A wire shaped electron source, comprising:

a heating core means for generating heat;

an insulator means fixed on an outer surface of said heating core means so as to define an integral unit together with said heating core means, said insulator means partially covering said outer surface of said heating core means; and an electron emission means provided on said outer surface of said heating core means at places other than those provided with said insulator means;

wherein said insulator means has a height, as measured from said outer surface of said heating core means, which is greater than the thickness of said electron emission means on said heating core means.

* * * * *